United States Patent [19]

Gabrielidis

[11] 4,249,729

[45] Feb. 10, 1981

[54] TENNIS EXERCISE AID

[76] Inventor: Pericles Gabrielidis, 14141 Riverside Dr., #2, Sherman Oaks, Calif. 91423

[21] Appl. No.: 104,198

[22] Filed: Dec. 17, 1979

[51] Int. Cl.[3] ..... A63B 61/00

[52] U.S. Cl. ..... 273/29 A; 272/135; 272/137; 272/140; 272/142; 272/68

[58] Field of Search ..... 273/26 R, 26 B, 29 A, 273/67 R, 72 R; 272/76, 137, 142, 135, 140, 68, 143

[56] References Cited

U.S. PATENT DOCUMENTS 2,099,521 11/1937 Herkimer et al. ..... 273/72 R
2,201,263 5/1940 Hall ..... 273/73 J
3,606,326 9/1971 Sparks et al. ..... 273/72 R

FOREIGN PATENT DOCUMENTS 2587 of 1899 United Kingdom ..... 272/135

*Primary Examiner*—Richard C. Pinkham
*Assistant Examiner*—T. Brown
*Attorney, Agent, or Firm*—Allan M. Shapiro

[57] ABSTRACT

Tennis exercise aid comprises a tight wound tension spring having a manual handle at each end. One manual handle is in the form of a tennis racket handle, and the other is a resilient foam-covered tennis racket handle. The one manual handle is covered with a material different from the resilient foam-covered other handle.

2 Claims, 4 Drawing Figures

TENNIS EXERCISE AID

BACKGROUND OF THE INVENTION

This invention is directed to a tennis exercise aid and is a structure which permits the exercise of the muscles particularly used in the game of tennis without requiring a tennis court.

Good physical condition is necessary to a tennis player. All general conditioning exercises are important, but there are specific exercises which strengthen and condition the muscles which are particularly used in the game of tennis.

A number of exercise devices are available, and some of these available devices are purported to be useful in strengthening the muscles used in tennis. However, no available exerciser is structured so that it can be used as a grip strengthener and as an aid for the exercising of the musculature employed in actual tennis strokes, as well as being useable in general conditioning exercises.

SUMMARY OF THE INVENTION

In order to aid in the understanding of this invention, it can be stated in essentially summary form that it is directed to a tennis exercise aid with first and second handle ends on a tight wound tension spring. One of the handles has the shape of a tennis racket handle, and the other has a similar internal hard shape which is covered with resilient foam material. Grasping of the tennis handle permits the practice of tennis strokes, while grasping of the foam handle requires a tighter grip to enhance grip musculature.

It is thus an object of this invention to provide a tennis exercise aid which is capable of being employed to swing like a tennis racket to exercise those muscles which are used in actual tennis strokes. It is another object to provide a tennis exercise aid which has a resilient foam-covered handle to require a stronger grasp to strengthen handle grip musculature. It is a further object to provide a tennis exercise aid which is of small size and economic of manufacture so that it can be widely used by those interested in tennis and tennis exercises. It is a further object to provide a tennis exercise aid which is capable of being used in general conditioning as well as the specific conditioning of the muscles used in playing tennis.

The features of the present invention which are believed to be novel are set forth with particularity in the appended claims. The present invention, both as to its organization and manner of operation, together with further objects and advantages thereof, may be best understood by reference to the following description taken in conjunction with the accompanying drawings.

DESCRIPTION OF THE PREFERRED EMBODIMENT

Figure 1:
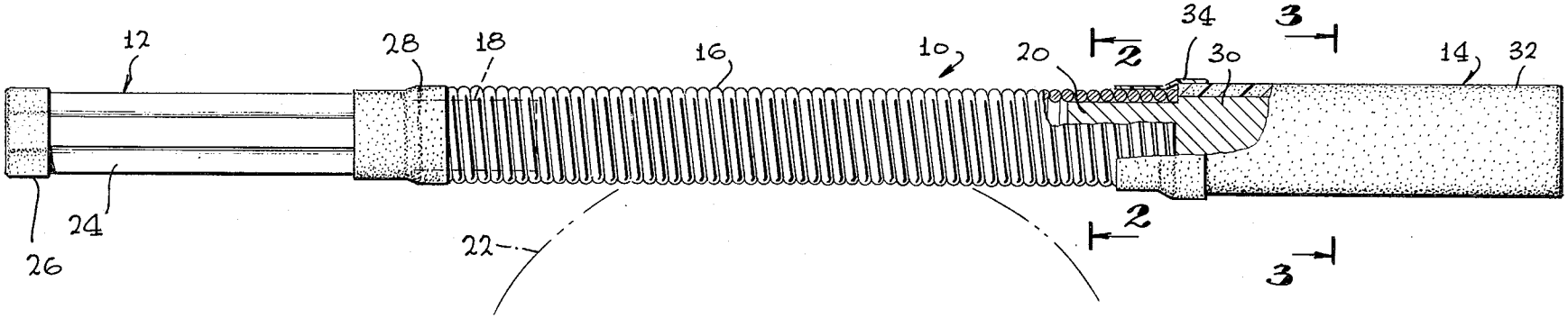
FIG. 1 is a side-elevational view of the tennis exercise aid of this invention, with parts broken away and parts taken in section.
Figure 4:
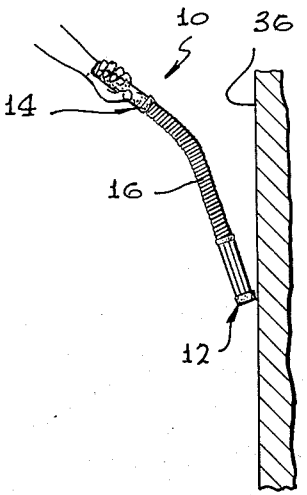
FIG. 4 is a side-elevational view of the tennis exercise aid shown in use in a gripstrengthening exercise.
Figure 3:
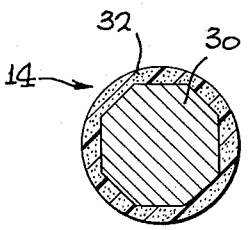
FIG. 3 is another transverse section, taken generally along the line 3—3 of FIG. 1.
Figure 2:
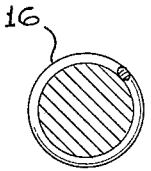
FIG. 2 is a transverse section taken generally along the line 2—2 of FIG. 1.

The tennis exercise aid of this invention is generally indicated at 10 in FIGS. 1 and 4. It has handles 12 and 14 and central spring 16. Handle 12 has a cylindrical rod 18 formed thereon which extends into the left end of spring 16, while handle 14 has a similar rod 20 which extends into the other end of central spring 16, see FIGS. 1 and 2. These cylindrical rods are tightly engaged within the spring so that the two handles and spring form a unitary structure. The ends of the spring can be slightly unwound during the handle insertion so that the tightening of the spring tightly engages upon the inwardly extending rod portions of the handles.

Spring 16 is a tension spring and is tightly wound. This means that, at rest, the coils lie against each other and are spring-stressed together. The spring, by its internal forces, tends to hold its coils longitudinally together and thus, at rest, the spring is a straight tubular structure. A certain amount of bending force is necessary before the spring starts to bend, and this bending force is regulated to be such that its value is appropriate as an exercise. With such bending, the spring bends down with its center line approximately along line 22. The resiliency of the spring itself provides a force which urges the spring back to the straight line position shown in FIG. 1.

Handle 12 is configured as a standard tennis racket handle. In this sense, it is octagonal and is wound with a high friction, firm grip material such as a leather or a solid rubber strip to form the grasp region 24. On the usual tennis racket handle, such a strip is diagonally wrapped around the rigid inner material, oftentimes wood. Cup 26 is secured around the outer end of handle 12 to secure the end of the strip material and to provide a covering over the entire outer end of the handle. Sleeve 28, for example a resilient rubber tube, engages over the inner end of the handle and around the outer end of spring 16 to form a transition.

Handle 14 is similar to handle 12 in that it has an octagonal rigid inner core 30 preferably made of wood. The octagonal portion has the same general dimensions as a tennis racket handle. It is formed with the previously described cylindrical rod 20. Resilient foam cover 32 is secured over core 30. Sleeve 34, of the same nature as sleeve 28, engages over both the foam covering 32 and the spring to form the transition on that end. Foam covering 32 is soft so that the octagonal rigid portion of the handle can be felt, as compared to the quite rigid exterior structure of handle 12.

FIG. 4 illustrates the manner in which the tennis exercise aid 10 is used in exercises for strengthening forehand and backhand strokes. The handle 12 is placed against a vertical object, such as wall 36, and the hand of the tennis exerciser grasps the foam-covered handle 14. The arm is urged toward the wall at an angle thereto to bend spring 16, as illustrated in FIG. 4. The bending of the spring is produced by the force of the hand on handle 14. The foam covering on handle 14 requires a stronger grasp than a standard handle so that the hand grasp also is strengthened with the arm muscles as the arm is moved to bend spring 16. With the soft foam handle, the grip of the hand to hold the exercise aid 10 must be much tighter than on the usual firm surfaced tennis racket handle. This additional strength of grip strengthens the muscles necessary for the tennis handle grip during regular use. In addition, the tennis exercise aid 10 may be used purely as a gripping device by holding the foam-covered handle in one hand after the other for squeezing repetitions.

General conditioning exercises are also practical with the tennis exercise aid. When gripped in both hands, it can be used in forward bending exercises. Similarly, it can be used in sideways waist-bending exercises. Also, when so held, it can be used in waist-twisting exercises. Various shoulder and arm exercises are achieved by gripping the tennis exercise aid with one hand on each of the handles. In this position, with arms straight, the spring 16 can be bent downward with the palms facing down, and also upward with the palms facing up. In this position, it can also be used in situps. With the hands on the spring 16 inboard of the handles, twisting along the longitudinal axis of spring 16 produces wrist exercise. With the same hold on the exercise aid 10, the spring 16 can be stretched using the knees between the wrist to employ also the leg muscles for the stretching forces.

Thus, the octagonal shape of the tennis racket handle underneath the foam provides a tennis exercise aid which produces especially desirable hand and forearm strengthening through the squeezing of the foam-covered grip on the octagonal handle.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A tennis exercise aid comprising:

a tight wound tension spring having first and second ends;

first and second manually graspable handles respectively secured to said first and second ends of said spring, said first handle being configured to be used as a standard tennis racquet handle and being substantially octagonal in cross section, a high friction covering on said first handle, said second handle having a core of rigid material having a substantially octagonal cross-sectional configuration and having a covering material thereon different from said covering on said first handle, said covering material comprising a resilient foam so that said second handle requires a firm manual grasp thereon.

2. The tennis exercise aid of claim 1 wherein a sleeve engages over a portion of said spring onto a portion of one of said handles to form a transition therebetween.

* * * * *